US005104728A

United States Patent [19]

Obermeyer et al.

[11] Patent Number: 5,104,728

[45] Date of Patent: Apr. 14, 1992

[54] ULTRASONICALLY BONDED FABRIC AND METHOD OF MAKING SAME

[75] Inventors: Edward A. Obermeyer, Vancouver, Wash.; Arthur H. Cashin, Greer, S.C.

[73] Assignee: Fiberweb, North America, Inc., Greenville, S.C.

[21] Appl. No.: 147,198

[22] Filed: Jan. 22, 1988

[51] Int. Cl.[5] ..... B32B 5/26

[52] U.S. Cl. ..... 428/286; 428/298; 428/302; 428/447

[58] Field of Search ..... 156/73.1, 73.2; 428/266, 391, 341, 447, 296, 302, 298, 286

[56] References Cited

U.S. PATENT DOCUMENTS 4,020,212 4/1977 Erickson ..... 428/391

4,376,149 3/1983 Martin ..... 428/266

*Primary Examiner*—Jenna L. Davis

*Attorney, Agent, or Firm*—Finnegan, Henderson, Farabow, Garrett & Dunner

[57] ABSTRACT

An ultrasonically bonded fabric comprising a non-woven coverstock treated with an organosilicone material, e.g., an organosilicone fluid, prior to being ultrasonically bonded to another material. The ultrasonically bonded fabric as made by treating a non-woven coverstock with the organosilicone material and ultrasonically bonding the treated non-woven coverstock to the other material.

4 Claims, No Drawings

ULTRASONICALLY BONDED FABRIC AND METHOD OF MAKING SAME

BACKGROUND OF THE INVENTION

1. Field of the Invention

The present invention relates to an ultrasonically bonded fabric and a method of making the same.

2. Description of the Related Art

Converting fabrics by ultrasonic bonding using a horn and anvil roller is known. This is taught, for example, in U.S. Pat. No. 4,406,720 and 4,414,045 to Wang et al. Ultrasonic bonding has been used in bonding waist bands on disposable diapers. As a reciprocating horn approaches its timed mating with a rotating anvil, the fabric to be bonded is pinched. As the fabric moves across the face of the horn, excess energy often develops therebetween. This excess energy causes problems with "burn through" or otherwise weakening of the bond.

To a certain extent, this burn through problem can be solved by balancing the amount of contact between the horn and the fabric with the amount of energy expended in the bonding process. Also, increasing the basis weight of the fabric can aid in alleviating the burn through problem.

In addition to the burn through problem, tearing problems are prevalent in ultrasonically bonded fabrics. However, the tearing does not tend to occur within the actual bond site, but rather beyond the outer edge of the site.

The tearing is attributed to the development of mechanical stress in the fabric. When the horn and anvil come together the fabric at the bond site is held tight, while the fabric downstream of the bond site is being drawn away. As such, excessive stress is placed on that part of the fabric immediately adjacent the bonding mechanism on the downstream side which may cause the fabric to tear.

It has been observed that carded fabrics that contain crimped fibers overcome this tearing problem by allowing a small, sudden extension of the crimped fiber to alleviate the stress on the fabric at the instant it is pinched by the bonding mechanism.

However, with spunbonded non-woven fabric this stress cannot be relieved by the extension of a crimp. The stress must be borne solely by the fabric. Indeed, it is at this point (i.e., where the fabric undergoes ultrasonic bonding), that the fabric is weakest and susceptible to tearing. Convertability of a fabric by ultrasonic bonding is the ability to produce bonded fabrics without fabric failure, i.e., burn through or tearing.

It is therefore an object of the present invention to overcome the disadvantage of the prior art and to provide an improved ultrasonically bonded fabric and method of making the same.

It is another object of the invention to improve the convertibility of non-woven fabrics in an ultrasonic bonding process.

It is a further object of the present invention to reduce the stress developed in a non-woven fabric during ultrasonic bonding.

It is a still further object of the present invention to enhance the lubricity of a non-woven fabric.

It is another object of the present invention to improve the liquid transport properties of the non-woven component of the bonded fabric.

Additional objects and advantages of the invention will be set forth in the description which follows, and in part will be apparent from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there are provided an ultrasonically bonded fabric which comprises a non-woven coverstock treated with an organosilicone material prior to being ultrasonically bonded to another material, and a method of making an ultrasonically bonded fabric which comprises treating a non-woven coverstock with an organosilicone material and ultrasonically bonding the treated non-woven coverstock to the other material.

The non-woven coverstock is preferably a non-woven fabric comprising spunbonded fibers of a polyolefin, e.g., polypropylene. The other material is preferably an anti-wetness, i.e., liquid impermeable material typically a polyethylene material.

A preferred organosilicone material used to treat the coverstock is an organosilicone fluid, e.g., an organomodified polydimethylsiloxane known as SILWET. SILWET is one of a family of organosilicone surfactants produced by Union Carbide. A particularly preferred SILWET is Product No. Y-12037.

The organosilicone surfactant is applied prior to the ultrasonic bonding step and may be applied in any manner known in the art which permits the compound to be evenly distributed over the fabric. For example, the compound may be applied as a foam in an amount to provide 0.001 to 0.004 g/m$^2$ of active ingredient on the fabric. The material may also be sprayed as a dilute solution of the organosilicone material on the fabric to provide the same distribution.

By treating the non-woven fabric in this manner, the lubricity of the fabric is enhanced which, consequently, improves its convertibility. The enhanced lubricity reduces the frictional forces encountered between the fabric and the bonding mechanism, thereby allowing the fabric to slip slightly as it is being drawn through the ultrasonic bonding mechanism. As such, the amount of stress placed on the fabric on the downstream side of the bonding site is lessened, which correspondingly decreases the possibility of tearing and improves convertibility.

It is also possible to treat the other material to be bonded in the manner described above. If, for example, the anti-wetness material is treated with the organosilicone material prior to bonding, such treatment will prevent the anvil from sticking to the material and subsequently pulling the bonded fabric apart as the anvil is retracted.

The silicone component of the organosilicone surfactant functions to enhance the lubricity so as to relieve stress and prevent the fabric from tearing. The organosilicone surfactant also functions to enhance liquid transport through the non-woven fabric. However, if an excess of the organosilicone surfactant is used, the silicone component may undesirably act as a water repellent. In order to achieve the desired properties, the organosilicone surfactant is applied to the fabric in an amount sufficient to provide lubricity and enhance liquid transport therethrough and insufficient to provide water repellancy. As described above, the active ingredient will be applied in an amount from 0.001 to 0.004 $g/m^2$ of fabric.

Thus, the present invention provides an ultrasonically bonded fabric comprising a non-woven coverstock treated with an organosilicone material prior to being ultrasonically bonded to another material. The other material is preferably an anti-wetness, i.e., liquid impervious material which is typically a polyethylene plastic. The bonded fabric may additionally comprise an absorbent material and/or an elastomer positioned between the coverstock and the anti-wetness material.

The present invention finds particular utility in disposable devices, e.g., diapers and the manufacture thereof. As is well known, disposable diapers comprise a liquid permeable coverstock, a liquid impermeable back sheet and an absorbent element positioned between the coverstock and the back sheet. In the diapers utilizing the concepts of the present invention, the non-woven coverstock which has been treated with an organosilicone surfactant is assembled with the absorbent element and the back sheet and is ultrasonically bonded to the back sheet.

Thus, in a particularly preferred embodiment, the present invention relates to and provides a disposable device for absorbing and containing liquids comprising a liquid permeable coverstock bonded, e.g., electrosonically bonded, to a liquid impermeable back sheet to enclose an absorbent element therebetween, said liquid permeable coverstock having dispersed thereon an organosilicone surfactant, e.g., an organomodified polydimethylsiloxane.

As described above, the organosilicone surfactant improves the liquid transport properties of the treated non-woven fabric. In a disposable diaper, the surfactant aids in passage of liquid through the treated fabric and into the absorbent material, and simultaneously prevents the liquid from passing back through the fabric. This is attributed to the presence of cross-linking components in the organosilicone molecules which bond the molecules to the fibers of the non-woven fabric so that the molecules do not wash-out or migrate and thereby remain evenly spread throughout the fabric. As such, the surfactant maintains proper orientation for optimum performance.

Thus, the present invention can be used to improve the convertibility of diaper coverstock in ultrasonic processing equipment and also significantly improve the liquid transport properties of the treated coverstock. The bonded diaper may additionally comprise an elastomer positioned between the diaper coverstock and the anti-wetness material.

The following examples are presented to illustrate the various features of the present invention.

EXAMPLE I

A first roll of spunbonded non-woven polypropylene fabric was treated with a commercially available surfactant normally used in the production of disposable diapers. A second roll was treated with Union Carbide's organomodified polydimethylsiloxane composition known as SILWET (Product No. Y-12037). Both rolls were converted into diapers in a machine which used ultrasonics to bond the fabric to an anti-wetness back sheet and incorporate an absorbent element therein.

The diapers formed were inspected for incidents of fabric failure at and around the bond sites. The organomodified polydimethylsiloxane composition which was applied prior to bonding provided superior convertibility in all cases as demonstrated by the reduction in fabric failure from 100% for the diapers made from the conventionally treated fabric to 0.1% for the diapers made from the fabric treated with organosilicone material according to the present invention.

In Example 2, infra, diaper samples from both rolls were tested for liquid transport characteristics.

EXAMPLE 2

A wetting test was conducted which required pouring a calibrated amount of synthetic urine on a diaper produced in accordance with the present invention, held at an angle. The urine swiftly passed through the diaper coverstock and into the underlying absorbent material. It was determined that the surfactant aided in liquid penetration and improved the liquid transport properties of the diaper.

Additional advantages and modifications will readily occur to those skilled in the art. The invention in its broader aspects is, therefore, not limited to the specific details described and examples shown. Accordingly, departures may be made from such details without departing from the spirit or scope of the general inventive concept as defined in the appended claims and their equivalents.

What is claimed is:

1. An ultrasonically bonded fabric comprising a non-woven coverstock that is ultrasonically bonded to an anti-wetness material wherein an absorbent material is positioned between the coverstock and the anti-wetness material and wherein the coverstock is treated with an organosilicone material prior to being ultrasonically bonded to the anti-wetness material to prevent failure of the fabric.

2. A disposable device for absorbing and containing liquids comprising a liquid permeable coverstock bonded to a liquid impermeable back sheet to enclose an absorbent element therebetween, said liquid permeable coverstock having dispersed thereon an organosilicone surfactant.

3. The disposable device as claimed in claim 2 wherein the organosilicone is dispersed in an amount of 0.001 to 0.004 $g/m^2$ of said liquid permeable coverstock.

4. The disposable device as claimed in claim 2, wherein said organosilicone material is an organomodified polydimethylsiloxane.

* * * * *